United States Patent [19]

Wheeler

[11] 4,123,990

[45] Nov. 7, 1978

[54] SLEEVE ASSEMBLY

[75] Inventor: John H. Wheeler, Dallas, Tex.

[73] Assignee: The Texacone Company, Dallas, Tex.

[21] Appl. No.: 850,654

[22] Filed: Nov. 11, 1977

Related U.S. Application Data

[62] Division of Ser. No. 721,984, Sep. 10, 1976, Pat. No. 4,089,137.

[51] Int. Cl.[2] ..... B05C 11/00

[52] U.S. Cl. ..... 118/76; 29/401 R; 427/11

[58] Field of Search ..... 118/76, 77, 78; 425/11, 425/12; 184/24, 25; 29/401 R; 427/11

[56] References Cited

U.S. PATENT DOCUMENTS

| | | | |
|---|---|---|---|
| 190,960 | 5/1877 | Davis | 15/104.04 |
| 471,269 | 3/1892 | Elliott | 184/25 |
| 512,166 | 1/1894 | Devine | 184/25 |
| 961,497 | 6/1910 | Horlick | 184/25 |
| 1,370,141 | 3/1921 | McNicholas | 51/73 GC |
| 1,822,521 | 9/1931 | Fox et al. | 15/256.5 |
| 1,898,964 | 2/1933 | Jinnett | 15/104.04 |
| 2,179,465 | 11/1939 | Blazek | 51/73 GC |
| 2,222,191 | 11/1940 | Zisman | 15/104.04 X |
| 2,641,008 | 6/1953 | Smita | 15/88 |
| 2,657,409 | 11/1953 | Dawson | 15/104.04 |
| 2,667,929 | 2/1954 | Hunt | 175/84 |
| 2,780,533 | 2/1957 | Hurst | 51/299 X |
| 2,782,436 | 2/1957 | Tomer | 15/104.04 |
| 2,813,285 | 11/1957 | Aslin et al. | 15/104.04 |
| 3,025,184 | 3/1962 | Blair et al. | 118/77 X |
| 3,117,401 | 1/1964 | Talley | 51/241 R |
| 3,189,935 | 6/1965 | Euga | 15/104.04 X |
| 3,258,882 | 7/1966 | Cohen | 51/241 R X |
| 3,527,611 | 9/1970 | Newfarmer | 134/6 |

FOREIGN PATENT DOCUMENTS

| | | | |
|---|---|---|---|
| 193,324 | 2/1923 | United Kingdom | 184/24 |

*Primary Examiner*—John P. McIntosh
*Attorney, Agent, or Firm*—Richards, Harris & Medlock

[57] ABSTRACT

A sleeve assembly for sanding, rust removing, and pit filling on a piston rod of a hydraulic cylinder or the like includes a sanding component, a rust removing component and a pit filling component. The sanding component comprises a rigid annular outer member, a resilient annular intermediate member adhesively secured to the inner surface of the outer member, and an abrasive annular inner member adhesively secured to the inner surface of the intermediate member and in interference contact with the piston rod. The rust component comprises an annular upper ring member composed of a rigid material and an elastomeric annular lower ring member having brass or bronze particles imbedded therein. The pit filling component comprises an annular upper ring composed of a rigid material and an elastomeric annular lower ring member having lead particles imbedded therein. Clamp means releasably engages the members of each of the components about the piston rod.

3 Claims, 9 Drawing Figures

SLEEVE ASSEMBLY

This is a division of application Ser. No. 721,984, filed Sept. 10, 1976 now U.S. Pat. No. 4,089,137, May 16, 1978.

BACKGROUND OF THE INVENTION

This invention relates generally to a sleeve assembly, and more particularly to a sleeve assembly for sanding, rust removing and pit filling on piston rods of the type utilized in hydraulic cylinder apparatus.

Hydraulic cylinder apparatus such as hydraulic elevators and the like utilize piston rods which take the form of relatively large diameter pipe sections. It is essential for the proper operation of such hydraulic cylinder apparatus that the piston rods have an outer surface that is free of rust and pits, that has smooth joints between adjacent sections, and that is of substantially uniform diameter throughout its length.

Generally, there are three methods by which a finished piston rod may be formed from an unfinished pipe section. One method is to first engine lathe the section of pipe to the desired diameter, and to then belt sand the pipe section to provide the necessary surface finish. Another method is to utilize a centerless grinder to mill the section of pipe to the desired diameter, and to then utilize a belt sander for finishing. Still another method is to utilize a belt sander for the entire machining and finishing operation. Although these methods are generally satisfactory for the manufacture of piston rods, they are nevertheless characterized by certain problems. Often, the finished piston rods are nonuniform in diameter. Another problem involves the fact that the use of a belt sander sometimes produces a rifling effect.

Long lengths of piston rods are typically formed in sections. Although the joints between adjacent sections of such a piston rod are usually smooth at the time the piston rod is manufactured, it is necessary to disassemble the piston rod for transportation and to subsequently reassemble the piston rod at the time it is installed. Upon reassembly, it is generally not possible to achieve the smooth joints between adjacent sections that were provided when the piston rod was manufactured, so that it is often necessary to sand the piston rod in order to provide smooth joints between adjacent sections.

Other problems related to the installation and use of relatively large diameter piston rods involve the fact that during transportation, such piston rods may sustain damage due to rough handling. Moreover, piston rods of the type utilized in hydraulic elevators and the like are sometimes left exposed at the construction site prior to installation. This can lead to rust and corrosion which must be removed before the piston rod can be installed. If the corrosion is of the electrolytic type, it can result in the surface of the piston rod being pitted to a greater or lesser degree. It has been found to be desirable to substantially fill surface pits of this type before the piston rod is placed in service.

The solution of these heretofore mentioned problems is provided by reference to the present invention, whereby sleeve assembly having sanding, rust removing and pit filling components is described. For instance, rough joints and some foreign material may be removed from the outer surface of the piston rod by use of the sanding component of the present invention. The sanding component may be utilized on the outer surface of the piston rod by manually moving the sanding component over patches of foreign material or by releasably securing the sanding component near the stuffing box of the hydraulic cylinder apparatus and actuating the piston rod in an axial direction, thereby sanding the entire outer surface of the piston rod.

The rust removing component may be used to remove foreign materials which are not conveniently removed by the sanding component, such as relatively soft rust or corrosion that would tend to load up the sanding component too quickly. After the sanding sleeve and/or rust removing components are utilized, the pit filling component is used to burnish and heal the piston rod. The pit filling component also fills any pits or scratches that may be present on, the outer surface of the piston rod.

SUMMARY OF THE INVENTION

In accordance with the present invention, a sleeve assembly for sanding, rust removing and pit filling on a piston rod of a hydraulic cylinder or the like includes a sanding component, a rust removing component and a pit filling component. The sanding component comprises a rigid annular outer member, a resilient annular intermediate member adhesively secured to the inner surface of the outer member, and an abrasive annular inner member adhesively secured to the inner surface of the intermediate member and in interference contact with the piston rod. Each of the members has first and second sections which engage to form the members and include first and second end portions which have opposed non-axial configurations which cooperate when the sections engage. With the inner member in interference contact with the piston rod, relative movement between the sleeve assembly and the piston rod in an axial direction is effected, either by actuating the piston rod or by manually moving the sleeve assembly. The rust removing component comprises an annular upper ring member composed of a rigid material and an elastomeric annular lower ring member having bronze or brass materials imbedded therein. The pit filling component comprises an annular upper ring member composed of a rigid material and an annular lower ring member having lead particles imbedded therein. Clamp means releasably engages the members of each of the components about the piston rod.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
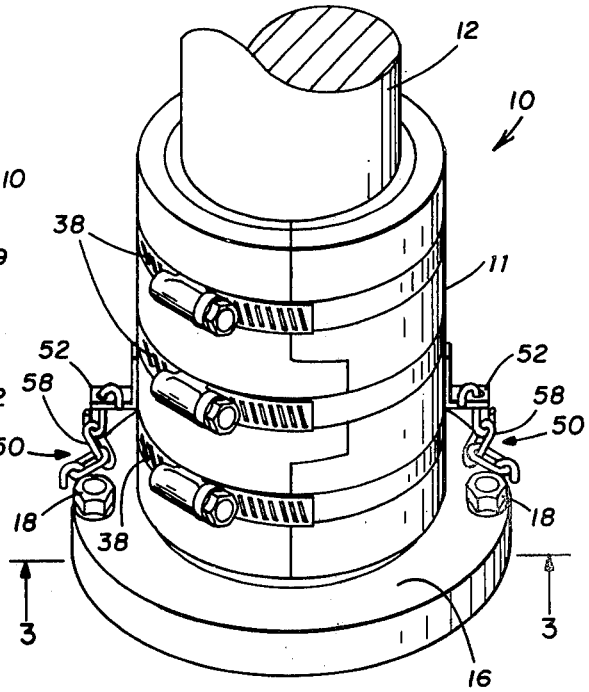
FIG. 1 is a perspective view of the sanding component engaged about a piston rod.
Figure 4:
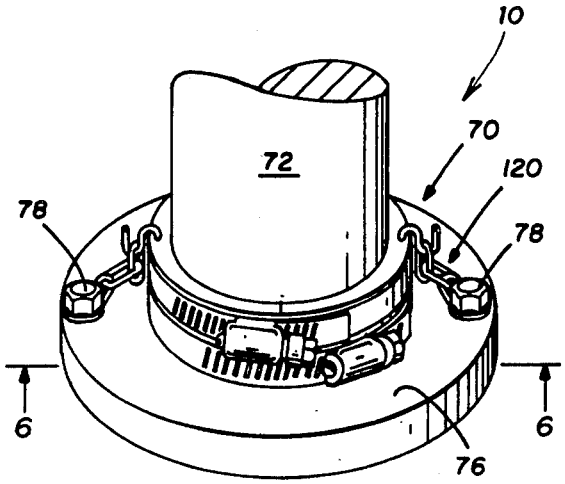
FIG. 4 is a perspective view of the rust removing component engaged about the piston rod.
Figure 7:
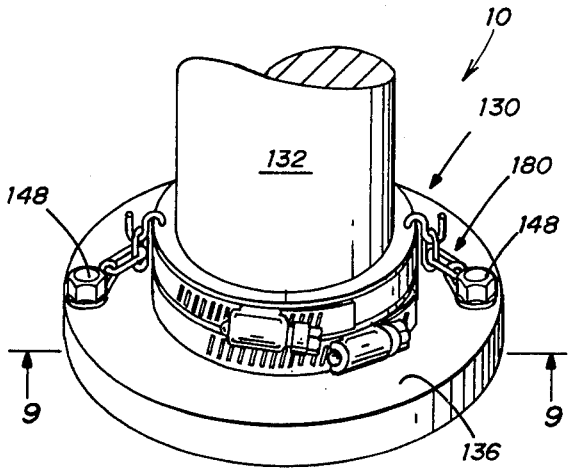
FIG. 7 is a perspective view of the pit filling component engaged about the piston rod.

Referring now to FIGS. 1, 4, and 7, there is shown a sleeve assembly generally referred to as reference numeral 10. Sleeve assembly 10 is releasably engageable about a piston rod such as piston rod 12 which is normally part of apparatus for a hydraulic cylinder used in hydraulic elevator shafts, but may be used for any piston-type apparatus. Sleeve assembly 10 includes three components, sanding component 11, rust removing component 70, and pit filling component 130. These components of sleeve assembly 10 are engaged independently about piston rods 12, 72, and 132, but collectively produce the desired smooth outer surface of each of these piston rods.

Figure 2:
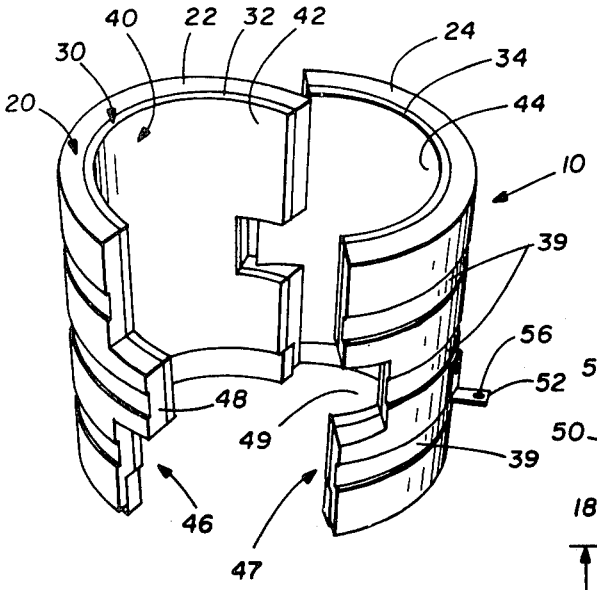
FIG. 2 is an exploded view of the sanding component.
Figure 3:
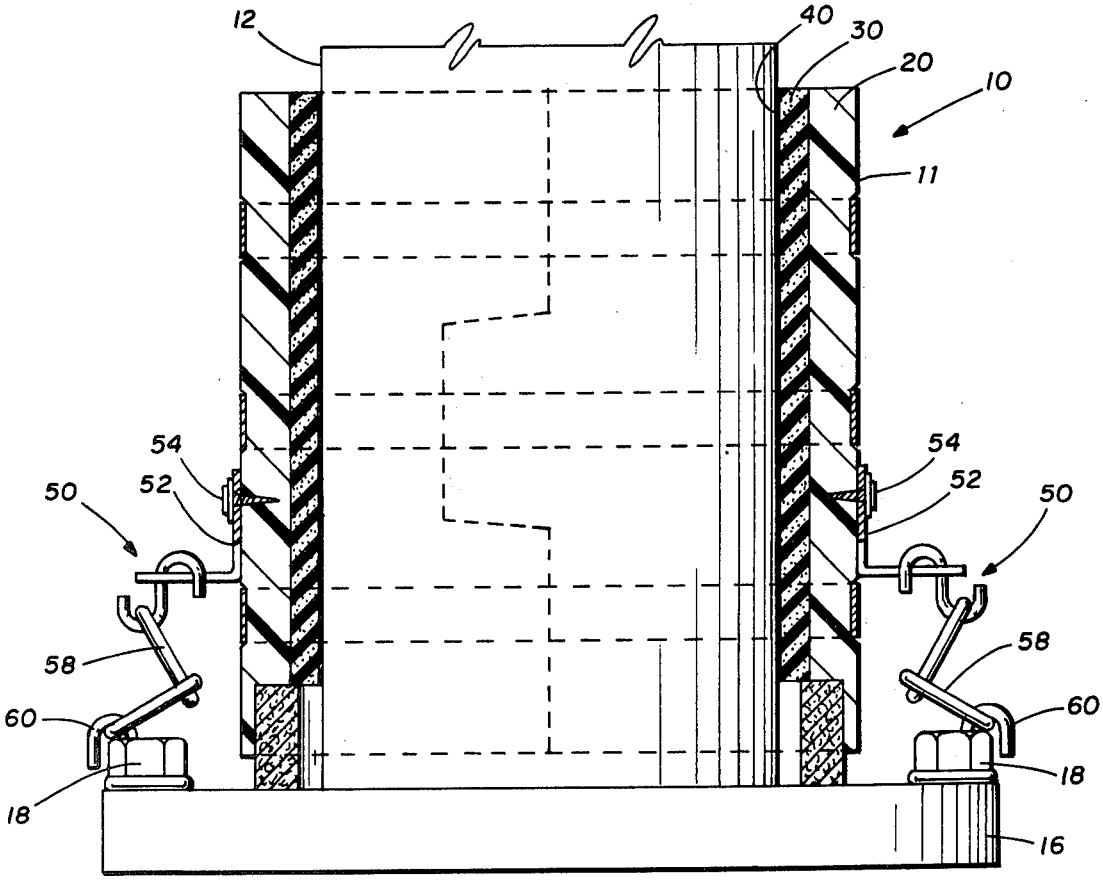
FIG. 3 is a sectional view of the sanding component taken along the lines 3—3 of FIG. 1.

Referring now to FIGS. 1, 2, 3, the sanding component 11 of sleeve assembly 10 includes rigid annular outer member 20, resilient annular intermediate member 30, and abrasive annular inner member 40. Members 20, 30, and 40 of sanding component 11 are annular in construction and completely encircle piston rod 12 during normal operation of sanding component 11. Members 20, 30, and 40 cooperate together to sand the outer surface of piston rod 12, thereby smoothing rough joints, removing soft layers of rust, and removing the rifling effect caused by use of the belt sander.

As seen more clearly in FIG. 2, outer member 20 is comprised of first and second sections 22 and 24 which engage with each other to form outer member 20. Outer member 20 provides a solid portion of sanding component 11 whereby clamp means may encircle the outer member without crushing or collapsing sanding component 11. Sections 22 and 24 are constructed from any rigid material, but preferably are constructed from a phenolic material.

Intermediate member 30 is comprised of sections 32 and 34 which are adhesively secured to the inner surface of sections 22 and 24 of outer member 20. Intermediate member 30 provides the means for inner member 40 to adhere thereto, yet permitting easy replacement of inner member 40 as hereinafter described. Sections 32 and 34 are generally constructed from a resilient elastomeric material such as a foam or sponge type elastomeric material, but other materials of equal facility may be utilized. Sections 32 and 34 are secured to the inner surface of outer member 20 by a suitable adhesive such as rubber cement, manufactured by Le Pages.

Inner member 40 is comprised of sections 42 and 44 which are adhesively secured to the inner surface of sections 32 and 34 of intermediate member 30. Inner member 40 acts directly upon piston rod 12 to sand the outer surface of piston rod 12. Sections 42 and 44 of inner member 40 are generally comprised of a layer of abrasive material such as sandpaper, emery cloth, crocus cloth or the like, which are suitable for sanding a metallic surface such as piston rod 12. Suitable adhesive such as that described for use on sections 32 and 34 of member 30 may be used for sections 42 and 44 of member 40. Although sections 42 and 44 are adhesively secured to the inner surface of intermediate member 30, they may be easily removed therefrom for replacement purposes following wear through usage of sanding component 11 on piston rod 12. Thus, the present invention provides a means for sanding the outer surface of piston rod 12 and upon prolonged use and wear of the sections 42 and 44 of inner member 40, easy replacement may be effected and if further sanding is desired, little time is lost in effectuating a replacement of the sections 42 and 44 of inner member 40.

Sanding component 11, and particularly inner member 40, is designed to come in interference contact with piston rod 12 when the sections of members 20, 30 and 40 engage with each other. After sanding component 11 encircles piston rod 12, relative movement in an axial direction between the sanding component 11 and piston rod 12 is effected, either by actuating the piston rod 12 or by manually moving the sanding component 11. Through this action, piston rod 12 is sanded to remove foreign materials that are relatively hard in nature, to smooth rough joints between adjacent sections, and to remove the rifling effect on a piston rod caused by use of a belt sander. Thus, sanding component 11 provides apparatus for placing a piston rod of a hydraulic cylinder or the like in proper condition for smooth operation of the piston rod.

Sections 22 and 24, 32 and 34, and 42 and 44 of members 20, 30 and 40, respectively, each include first and second end portions 46 and 47 which have opposed non-axial configurations. End portion 48 of one section of a member mates with end portion 49 of an opposed section of the same member to form a cylinder-like member. End portions 48 and 49 should have a non-axial configuration so that the sleeve assembly 10 does not score the piston rod. For example, stepped, inclined, mitered or pointed configurations may be used. In the preferred embodiment, end portion 46 includes a nose portion 48 which is releasably engageable into a cavity 49 of end portion 47. When the sections of members 20, 30 and 40 are engaged, nose 48 of end portion 46 engages in the cavity 49 of end portion 47 and the sections cooperate to form a uniform cylinder-like body encircling piston rod 12.

Members 20, 30 and 40 of sanding component 11 are releasably engageable about piston rod 12 and are held in the engaged position by a plurality of clamps 38 which fit within grooves 39 of outer member 20. In the preferred embodiment, clamps 38 are hose type clamps which may be expanded or contracted in circumference in the conventional manner. Thus, clamps 38 fit within grooves 39 of outer member 20 to releasably engage sanding component 11 about the piston rod 12.

Sanding component 11 of sleeve assembly 10 further includes chain assembly 50 which retains the sanding component 11 in the vicinity of a stuffing box 16 into which piston rod 12 is received. Chain assembly 50 includes angle bars 52 which are L-shaped in construction and are screwed with screws 54 to sections 22 and 24 of outer member 20. Angle bars 52 have apertures 56 into which the upper end of S links 56 is inserted. The lower end of links 56 is connected to hooks 60 which are secured to stuffing box 16 by bolts 18.

When sanding component 11 is used to sand or remove foreign material on piston rod 12, and piston rod 12 is actuated in an axial direction, sanding component 11 is retained near stuffing box 16 by chain assembly 50. If manual movement of sanding component 11 is desired, chain assembly 50 is detached from angle bars 52 and free movement of sanding component 11 in an axial direction along the length of piston rod 12 is now possible. Thus, sanding component 11 sands and removes foreign material on piston rod 12 either by actuating piston rod 12 or sanding component 11 in an axial direction.

Figure 5:
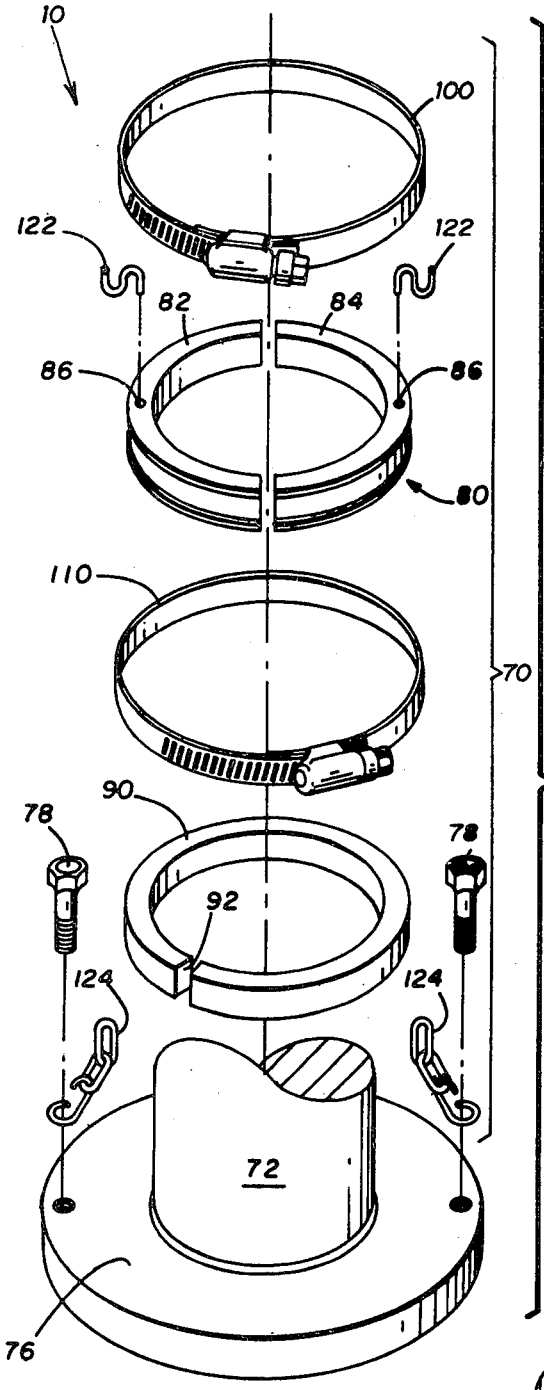
FIG. 5 is an exploded view of the rust removing component.
Figure 6:
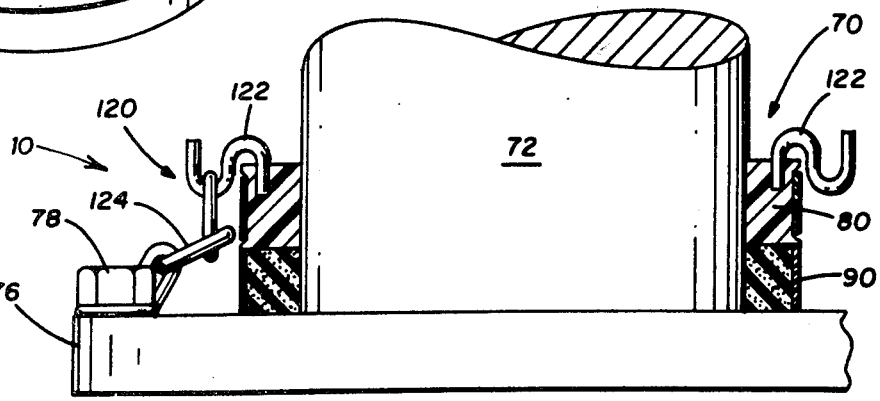
FIG. 6 is a sectional view of the rust removing component taken along the lines 6—6 of FIG. 4.

Referring now to FIGS. 4–6, there is depicted the rust removing component 70 of the sleeve assembly 10. Rust removing component 70 may be used on the outer surface of piston rod 72 to remove foreign materials which are not conveniently removed by the sanding component 11. Foreign materials such as relatively soft rust or corrosion tend to load up the sanding component too quickly, thus rust removing component 70 provides excellent apparatus for removing these foreign materials which will not load up the rust removing component 70 too quickly.

Rust removing component 70 is comprised of an upper ring member 80 and a lower ring member 90. Ring members 80 and 90 are annular in construction and completely encircle piston rod 72 during normal operation of rust removing component 70. As seen more clearly in FIG. 5, upper ring member 80 is comprised of first and second sections 82 and 84 which engage with each other to form upper ring member 80. Sections 82 and 84 are constructed from any rigid material, but preferably are constructed from a phenolic material.

Rust removing component 70 further comprises lower ring member 90 which is constructed from an elastomeric material having bronze or brass materials imbedded therein. These materials readily remove the foreign material on the outer surface of piston rod 12. Lower ring member 90 is positioned between upper ring member 80 and stuffing box 76 and includes a void 92 which permits the lower ring member 90 to open and encircle the piston rod 72.

Rust removing component 70 is designed to come in interference contact with piston rod 72 when sections 82 and 84 of upper ring member 80 engage with each other. First clamp means 100 releasably engages the sections 82 and 84 to each other and holds upper ring member 80 in interference contact with piston rod 72. Lower ring member 90 which includes void 92 permitting lower ring member 90 to open and encircle piston rod 72 is held in interference contact with piston rod 72 by second clamp means 110.

Upper ring member 80 is retained in the vicinity of stuffing box 76 by retaining means 120 having a first coupling end portion 122 which is releasably insertable in apertures 86 of sections 82 and 84 of the upper ring member 80. Second coupling end portion 124 is retained to stuffing box 76 by bolt 78 and mates with first coupling end portion 122 to releasably retain upper ring member 80 in the vicinity of stuffing box 76.

Rust removing component 70 is designed to come in interference contact with piston rod 72 when sections 82 and 84 of upper ring member 80 engage with each other and when lower ring member 90 opens at void 92 and encircles piston rod 72. After rust removing component 70 encircles piston rod 72, relative movement in the axial direction between the rust removing component 70 and piston rod 72 is effected by actuating the piston rod 72. Thus, since lower ring member 90 is constructed from an elastomeric material having brass or bronze materials imbedded therein, rust and corrosion may be removed from the outer surface of piston rod 72 resulting in a smooth outer surface of piston rod 72.

Figure 8:
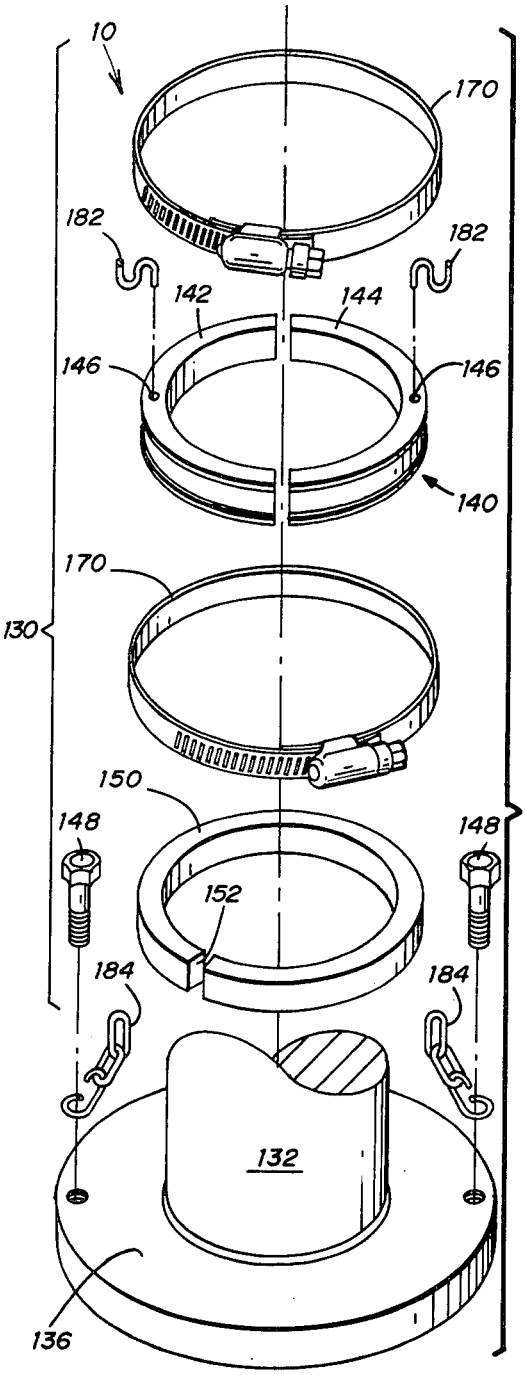
FIG. 8 is an exploded view of the pit filling component.
Figure 9:
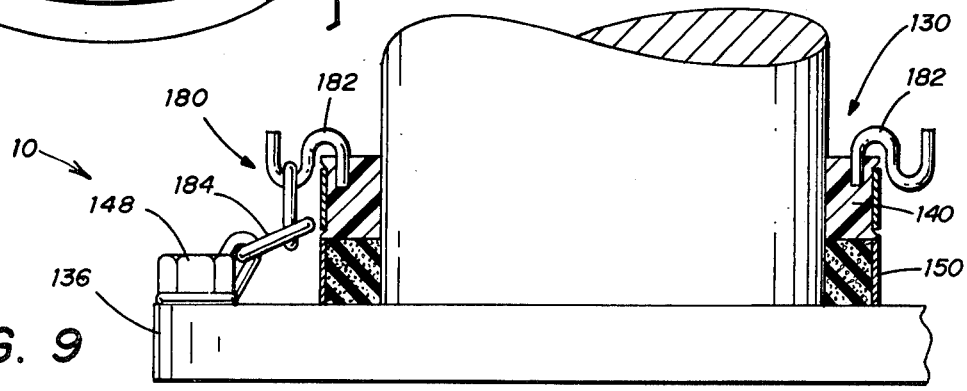
FIG. 9 is a sectional view of the pit filling component taken along the lines 9—9 of FIG. 7.

Referring now to FIGS. 7–9, there is depicted the pit filling component 130 of the sleeve assembly 10. Pit filling component 130 is primarily utilized on the outer surface of piston rod 132 for filling any pits or scratches that may be present on the outer surface of the piston rod 132. Moreover, the pit filling component 130 is utilized after application of the sanding component 11 and/or rust removing component 70 to the outer surface of piston rod 132, whereby the pit filling component 130 burnishes and heals the piston rod 132.

Pit filling component 130 is comprised of an upper ring member 140 and a lower ring member 150. Ring members 140 and 150 are annular in construction and completely encircle piston rod 132 during normal operation of pit filling component 130. As seen more clearly in FIG. 8, upper ring member 140 is comprised of first and second sections 142 and 144 which engage with each other to form upper ring member 140. Sections 142 and 144 are constructed from any rigid material, but preferably are constructed from a phenolic material.

Pit filling component 130 further comprises lower ring member 150 which is constructed from an elastomeric material having lead particles imbedded therein. This material readily fills any pits or scratches on the outer surface of the piston rod 132. Lower ring member 150 is positioned between upper ring member 140 and stuffing box 136 and includes a void 152 which permits the lower ring member 140 to open and encircle the piston rod 132.

Pit filling component 130 is designed to come in interference contact with piston rod 132 when sections 142 and 144 of upper ring 140 engage with each other. First clamp means 160 releasably engages the sections 142 and 144 to each other and holds upper ring member 140 in interference contact with piston rod 130. Lower ring member 150 which includes void 152 permitting the lower ring member 150 to open and encircle piston rod 132 is held in interference contact with piston rod 132 by second clamp means 170.

Upper ring member 140 is retained in the vicinity of stuffing box 136 by retaining means 180 having a first coupling end portion 182 which is releasably insertable in apertures 146 of sections 142 and 144 of the upper ring member 140. Second coupling end portion 184 is retained to stuffing box 136 by bolt 148 and mates with first coupling end portion 182 to releasably retain upper ring member 140 in the vicinity of stuffing box 136.

Pit filling component 130 is designed to come in interference contact with piston rod 132 when sections 142 and 144 of upper ring member 140 engage with each other and when lower ring member 150 opens at void 152 and encircles piston rod 132. After pit filling component 130 encircles piston rod 132, relative movement in the axial direction between the pit filling component 130 and piston rod 132 is effected by actuating the piston rod 132. When lower ring member 150 is constructed of an elastomeric material having lead particles imbedded therein, lead from member 150 is transferred into pits caused by electrolysis when corrosion on the outer surface of piston rod 132 is of the electrolytic type. Moreover, pit filling component 130 provides a means for filling any pits or scratches on the outer surface of piston rod 132.

The use of the sleeve assembly of the present invention is as follows. If rust or similar relatively soft corrosion or foreign matter is present on a piston rod of a hydraulic cylinder apparatus or the like, the rust removing component of the invention is utilized to remove the same. The brass or bronze particles imbedded in the elastomeric lower ring member of the rust removing component are soft enough so as to prevent scoring of the piston rod, and yet are hard enough to rapidly and efficiently remove rust or other foreign materials therefrom. The elastomeric matrix which supports the brass or bronze particles of the rust removing component allows such particles to be brought into firm engagement with the outer surface of the piston rods while the rust removing component is applied under uniform pressure around the entire circumference thereof. Finally, the construction of the rust removing component of the present invention prevents the apparatus from rapidly filling or loading with removed particles, thereby increasing the efficiency of the rust removing operation.

If the surface of the piston rod is scored, or if the piston rod has uneven joints between adjacent sections, or if relatively hard foreign material or corrosion is present on the surface of the piston rod, the sanding component of the sleeve assembly of the present invention is used. The sanding sleeve component may be utilized either manually, or it may be fixed in place, whereupon the piston rod is actuated to effect use of the sanding sleeve component. The construction of the sanding sleeve component assures an interference contact between the abrasive inner member thereof and the outer surface of the piston rod, and simultaneously assures uniform pressure of the abrasive inner member around the entire circumference of the piston rod. The abrasive inner member comprises an expendable item in the use of the present invention, and the construction of the sanding sleeve component facilitates the rapid replacement of the abrasive inner member when necessary.

Following the use of the rust removing component and/or the sanding sleeve component, or alternatively if the piston rod does not require the use of either the rust removing component or the sanding sleeve component but has surface scoring, scratches, pits, etc. thereon, the pit filling component of the sleeve assembly of the present invention is used. The pit filling component functions to rapidly burnish and heal the outer surface of the piston rod, thereby providing the extremely smooth and even surface finish that is desired thereon. Moreover, lead particles which are imbedded in the elastomeric substrate of the pit filling component are received in small scratches or pits that may be present on the outer surface of the piston rod, thereby filling the same and rendering the outer surface of the piston rod entirely smooth and even. The construction of the pit filling component assures that the lead particles thereof will be brought into intimate contact with the outer surface of the piston rod, and moreover assures uniform engagement of the lead particles around the entire circumference of the piston rod.

Thus, it is apparent that there has been provided, in accordance with the present invention, a sleeve assembly that fully satisfies the aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A sleeve assembly for filling pits and scratches on a piston rod of a hydraulic cylinder of the like having a stuffing box, which comprises:

(a) an annular upper ring member comprised of a rigid material and including first and second sections, the sections each having at least one aperture;

(b) an annular lower ring member comprised of a resilient material with lead particles imbedded therein and positioned between the upper ring member and a stuffing box which admits the hydraulic piston rod therethrough, the lower ring member having a void which permits the lower ring member to open and encircle the piston rod;

(c) retaining means for retaining the upper ring member to the stuffing box, the retaining means having a first coupling end portion releasably insertable in the apertures of the upper ring member sections and having a second coupling end portion releasably retained at the stuffing box;

(d) first clamp means for releasably engaging the first and second sections of the upper ring member to each other and in surrounding relationship with the piston rod; and (e) second clamp means for releasably retaining the lower ring member in interference contact with the piston rod.

2. The sleeve assembly of claim 1 wherein the upper ring member is comprised of a phenolic material.

3. The sleeve assembly of claim 2 wherein the lower ring member is comprised of an elastomeric material.

* * * * *

UNITED STATES PATENT AND TRADEMARK OFFICE

CERTIFICATE OF CORRECTION

PATENT NO. : 4,123,990

DATED : November 7, 1978

INVENTOR(S) : JOhn H. Wheeler

It is certified that error appears in the above-identified patent and that said Letters Patent are hereby corrected as shown below:

ABSTRACT, line 12, "ring" should be --C-ring--.
line 16, "ring" should be --C-ring--.
Col. 1, line 62, after "whereby", insert --a--.
Col. 2, line 50, "detailed" should be --Detailed--.
line 51, "description" should be --Description--.
line 51, "drawings" should be --Drawings--.
Col. 3, line 16, ", but" should be --to--.
line 17, "surface of" should be --surface on--.
line 28, "soft" should be --hard--.
Col. 4, line 16, "on a piston rod" should be --such as that--.
line 22, "include" should be --includes--.
line 54, "end" should be --ends--.
line 54, "is" should be --are--.
line 55, "end" should be --ends--.
line 55, "is" should be --are--.
Col. 5, line 18, after "second", insert --semicircular--.
line 20, "are" should be --can be--.
line 23, "ring" should be --C-ring--.
line 29, "ring" should be --C-ring--.
line 37, "ring" should be --C-ring--.
line 44, "of"first occurrence should be --in--.
line 57, "ring" should be --C-ring--.
line 59, "materials" should be --particles--.
line 68, "Moreover" should be --Preferably--.

UNITED STATES PATENT AND TRADEMARK OFFICE

CERTIFICATE OF CORRECTION

PATENT NO. : 4,123,990

DATED : November 7, 1978

INVENTOR(S) : John H. Wheeler

It is certified that error appears in the above-identified patent and that said Letters Patent are hereby corrected as shown below:

Col. 6, line 6, "ring" should be --C-ring--.
line 13, "are" should be --can be--.
line 16, "ring" should be --C-ring--.
line 19, "ring" should be --C-ring--.
line 29, "ring" should be --C-ring--.
line 50, "ring" should be --C-ring--.
Col. 7, line 3, "rods" should be --rod--.
Col. 8, lines 1-2, "engagement" should be --application--.

Signed and Sealed this

*Twentieth* Day of *May 1980*

[SEAL]

*Attest:*

SIDNEY A. DIAMOND

*Attesting Officer*

*Commissioner of Patents and Trademarks*